United States Patent [19]

Kimmerle et al.

[11] Patent Number: 5,047,093

[45] Date of Patent: Sep. 10, 1991

[54] HEAT TREATMENT OF ALLOY 718 FOR IMPROVED STRESS CORROSION CRACKING RESISTANCE

[75] Inventors: William L. Kimmerle, Canton; Marie T. Miglin, North Canton, both of Ohio

[73] Assignee: The Babcock & Wilcox Company, New Orleans, La.

[21] Appl. No.: 364,759

[22] Filed: Jun. 9, 1989

[51] Int. Cl.[5] ..... C21D 1/19

[52] U.S. Cl. ..... 148/162; 148/410

[58] Field of Search ..... 148/162, 410

[56] References Cited

U.S. PATENT DOCUMENTS 3,046,108 7/1962 Eiselstein ..... 75/171

3,972,752 8/1976 Honnorat et al. ..... 148/162

OTHER PUBLICATIONS

James, L. A. and Mills, W. J., "Effect of Heat Treatment and Heat-to-Heat Variations in the Fatigue Crack Growth Response of Alloy 718", Hanford Engineering Development Laboratory, HEDL-TME 80-9, UC-79, b, h, Apr. 1980, Part 1 & HEDL-TME 80-10, UC-79, b, h, Part 2.

Mills, W. J., "Effect of Heat Treatment on the Tensile and Fracture Toughness Behavior of Alloy 718 Weldments", Supp. to the Welding Journal, Aug. 1984, pp. 237s-245s.

Korth, Gary, "Mechanical Properties Test Data of Alloy 718 for Liquid Metal Fast Breeder Reactor Applications", Dept. of Energy, DOE Contract No. DE-AC07-761D01570, Jan. 1983.

Smolik, G. R. and Korth, G. E., "Reference Heat of Alloy 718 for Department of Energy Programs", Report TREE-1253, EG & G Idaho Inc., Apr. 1978.

Kimmmerle, W. L., Miglin, M. T., and J. L. Nelson, "Stress Corrosion Cracking of Alloy 718 in Pressurized-Water-Reactor Primary Water", *Superalloy* 718, ed. E. A. Loria, AIME, presented at International Symposium of Superalloy 718, Pittsburgh, Pa., Jun. 11-14, 1989.

Miglin, M. T. and Nelson, J. L., *Strain Rate Sensitivity of Alloy* 718 *Stress Corrosion Cracking*, Fontevraud II Conference Proceedings, Chinon, France, Sep. 10-14, 1990.

*Primary Examiner*—R. Dean

*Assistant Examiner*—Margery S. Phipps

*Attorney, Agent, or Firm*—Vytas R. Matas; Robert J. Edwards; Daniel S. Kalka

[57] ABSTRACT

A method of increasing intergranular stress corrosion cracking resistance of Alloy 718 in water reactor environments is disclosed. The Alloy is heat treated at a high annealing temperature to dissolve δ precipitates. The absence of δ particles at the grain boundaries increases the elemental homogeneity at the boundaries and increases intergranular stress corrosion cracking resistance. In addition, the absence of δ phase at the grain boundaries decreases the crack propagation rate.

4 Claims, 6 Drawing Sheets

HEAT TREATMENT OF ALLOY 718 FOR IMPROVED STRESS CORROSION CRACKING RESISTANCE

TECHNICAL FIELD

The present invention relates generally to a method for increasing intergranular stress corrosion cracking (IGSCC) resistance of Alloy 718 and, more particularly, to a method that improves the stress corrosion cracking resistance of this Alloy in light water reactor (LWR) environments and hydrogenated aqueous environments such as pressurized water reactors.

BACKGROUND ART

Alloy 718 is the most widely used iron-nickel-base superalloy. This Alloy possesses excellent strength, low cycle fatigue and creep behavior in addition to outstanding corrosion resistance in many environments. In addition, this Alloy is weldable and highly fabricable. Because of this, Alloy 718 has been used extensively in the aerospace industry and is being used more extensively in the nuclear power industry where high strength and excellent stress corrosion cracking resistance are important design criteria.

Since Alloy 718 was originally utilized in the aerospace industry, present heat treatment techniques for this Alloy were designed to optimize the high temperature mechanical properties required for air-breathing jet engine environments. The material requirements within the nuclear power industry are significantly different from those in aerospace applications, and thus, different heat treatment techniques are necessary. In particular, even though Alloy 718 has performed relatively well in light water reactor (LWR) environments, some failures have occurred, and it has been determined that these failures are the result of intergranular stress corrosion cracking (IGSCC). Prior to this time, to the best of the inventors' knowledge, there have not been any systematic studies to evaluate the effect of heat treatment, and therefore microstructure, on the intergranular stress corrosion cracking performance of Alloy 718 in light water reactor environments, and the development of a heat treatment method to optimize the performance of this Alloy in nuclear power reactor environments.

Even though a modified post-weld heat treatment was developed for Alloy 718 for used in liquid metal fast breeder reactors, heretofore conventionally heat treated Alloy 718 is being used in light water reactor environments with failures occurring as a result of intergranular stress corrosion cracking (IGSCC).

Accordingly, there is a need for a method to increase the IGSCC resistance of stock or unwelded Alloy 718 in light water reactor environments and in hydrogenated aqueous environments such as pressurized water reactors.

SUMMARY OF THE INVENTION

The present invention solves the problems associated with the prior art methods of heat treating and other problems by providing a method which improves the stress corrosion cracking resistance of Alloy 718 material (welded or unwelded). The method of the present invention includes annealing Alloy 718 at a temperature sufficient to dissolve the delta ($\delta$) precipitates. The absence of $\delta$ particles at the grain boundaries increases the elemental homogeneity at the grain boundaries and increases the intergranular stress corrosion cracking resistance of the material. In addition, the absence of a $\delta$ phase at the grain boundaries decreases the crack propagation rate of the material. The foregoing is accomplished with some decrease in the yield strength of the resulting material.

DESCRIPTION OF THE PREFERRED EMBODIMENT

The performance of precipitation-strengthened, corrosion-resistant alloys, such as Alloy 718, in light water reactors is generally good. These alloys are often used for bolts, springs, guide tube pins, and other structural members where high strength, relaxation resistance, and corrosion resistance are required. Failures, which are infrequent considering the number of components in service, can be attributed to fatigue, corrosion fatigue, and intergranular stress corrosion cracking (IGSCC). The metallurgical condition produced by thermomechanical processing greatly affects intergranular stress corrosion cracking.

Conventional Alloy 718, which is currently the form of this Alloy typically used by the nuclear power industry, is subject to variable processing conditions from one forge facility to another. The melt history and fraction of scrap Alloy 718 in the melt presents another uncontrollable variable. The resulting microstructure of conventional Alloy 718 can include the presence of embrittling laves phase, carbide stringers and grain size variation. The demands arising from the jet engine industry have resulted in the institution of stringent requirements on the melt practices for this Alloy.

The present invention involves an improved heat treatment method which increases the intergranular stress corrosion cracking resistance of Alloy 718 in hydrogenated aqueous environments, such as pressurized water reactor primary water. The present standard heat treatment method for Alloy 718 is set forth in Table I (below) and will be referred to hereinafter as the conventional heat treatment (CHT).

TABLE I

CONVENTIONAL HEAT TREATMENT

1) Solution annealed at 996° C. (1825° F.) for one hour.
2) Oil quench.
3) Aged at 718° C. (1325° F.) for eight hours.
4) Furnace cooled at 56° C. (132.8 degrees F.)/hour to 621° C. (1150° F.).
5) Aged at 621° C. (1150° F.) for total aging time of eighteen hours.
6) Air cooled to room temperature.

As previously indicated, the foregoing heat treatment method is the Present standard heat treatment method utilized in the jet engine industry.

The heat treatment method of the present invention, hereinafter known as the Modified Heat Treatment (MHT), is set forth in Table II below.

TABLE II

MODIFIED HEAT TREATMENT

1) Solution annealed at 1093° C. (2000° F.) for one hour.
2) Furnace cooled at 56° C. (132.8° F.)/hour to 718° C. (1325° F.).
3) Aged at 718° C. (1325° F.) for four hours.
4) Furnace cooled at 56° C. (132.8° F.)/hour to 621° C. (1150° F.).
5) Aged at 621° C. (1150° F.) for sixteen hours.
6) Air cooled to room temperature.

Figure 1A:
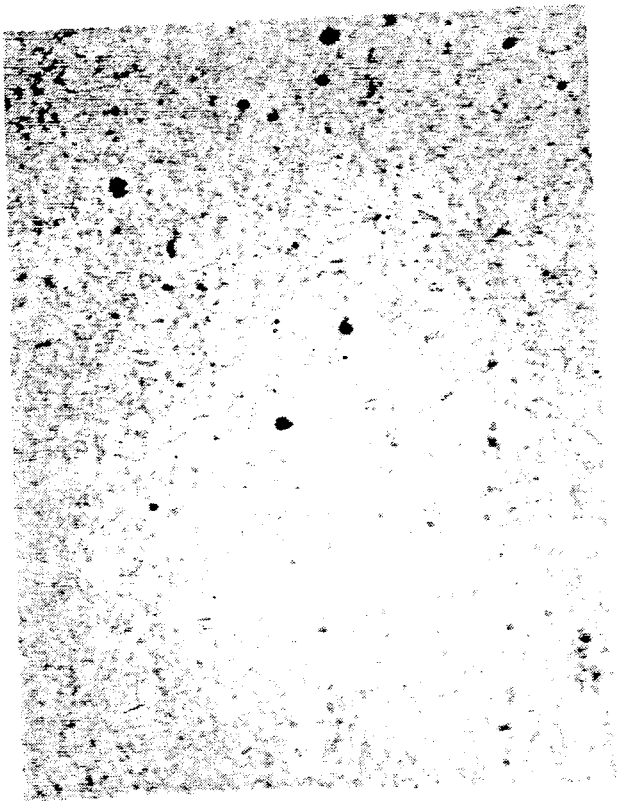
FIG. 1*a* is an optical micrograph of Alloy 718 in the conventional heat treatment (CHT) condition.
Figure 1B:
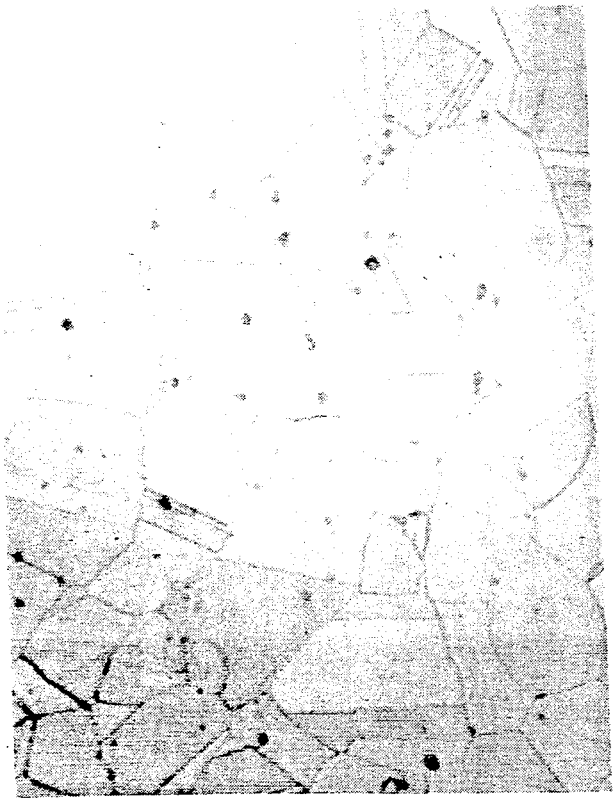
FIG. 1*b* is an optical micrograph of Alloy 718 in the modified heat treatment (MHT) condition.
Figure 2A:
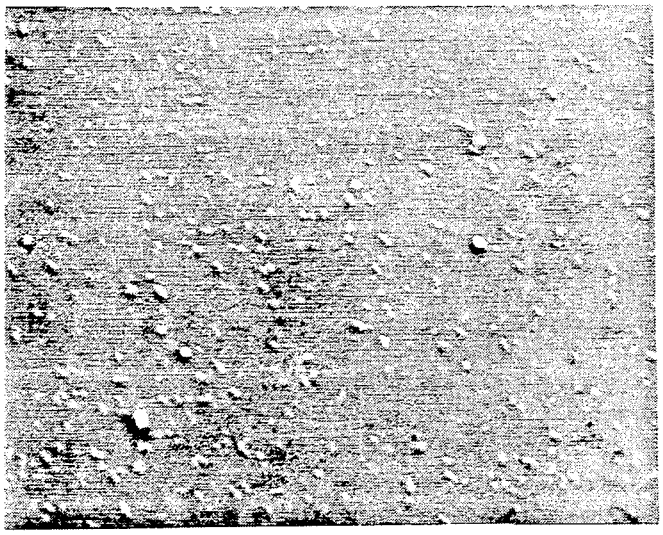
FIG. 2*a* is a scanning electron microscope (SEM) micrograph of Alloy 718 in the conventional heat treatment (CHT) condition and reveals the presence of carbides and intergranular delta phase.
Figure 2B:
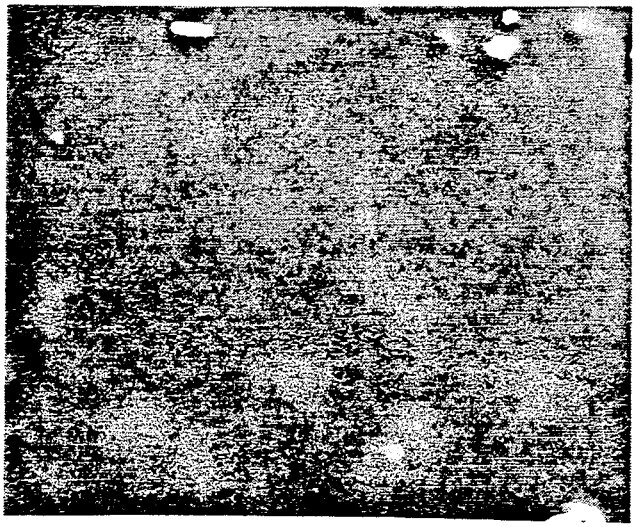
FIG. 2*b* is a scanning electron microscope (SEM) micrograph of Alloy 718 in the modified heat treatment (MHT) condition of the present invention and reveals the presence of carbides but essentially no delta phase precipitates at the grain boundaries.
Figure 3A:
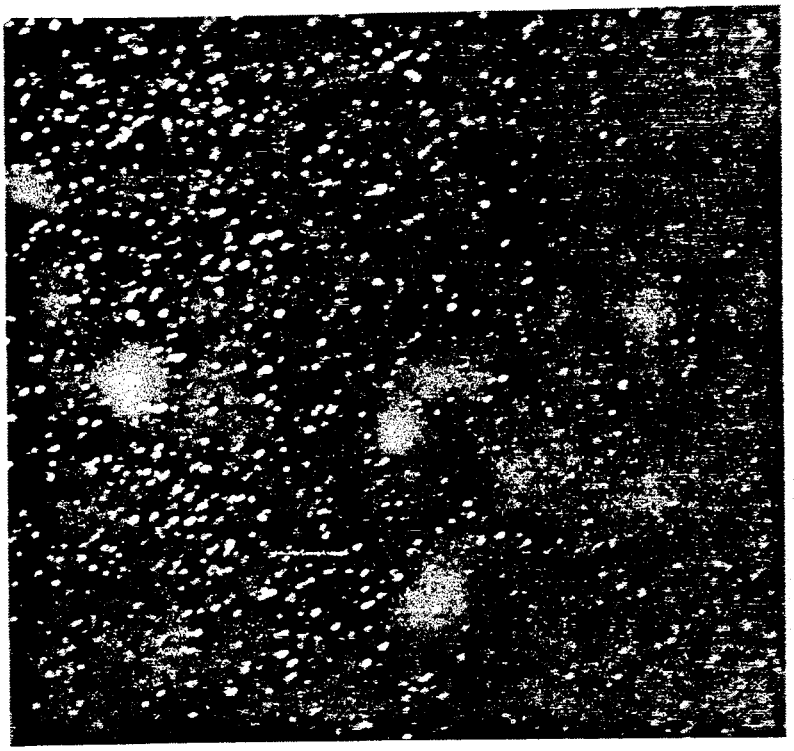
FIG. 3*a* is a dark field transmission electron microscope (TEM) micrograph of Alloy 718 in the conventional heat treatment (CHT) condition and reveals the $\gamma'$ and $\gamma''$ precipitate morphology therein.
Figure 3B:
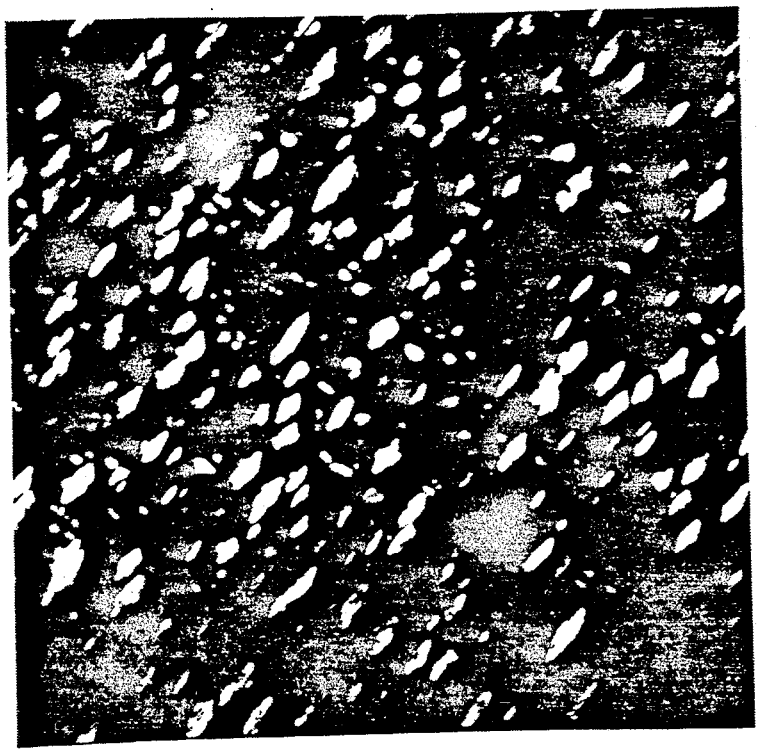
FIG. 3*b* is a dark field transmission electron microscope (TEM) micrograph of Alloy 718 in the modified heat treatment (MHT) condition of the present invention and reveals the $\gamma'$ and $\gamma''$ precipitate morphology therein.

Tests were conducted on samples of Alloy 718 material to identify and quantify the role of δ phase in intergranular stress corrosion cracking for this Alloy. Referring now to the photomicrographs of the conventional and modified heat treatment conditions of Alloy 718 in FIGS. 1*a* and *b*, it is apparent that the conventional heat treatment (CHT) condition is precipitation heat treated below the δ solvus, whereas the modified heat treatment condition is precipitation heat treated above the δ solvus. Delta phase which precipitates at the grain boundaries is used in the forging industry to control grain size during hot working. Scanning electron microscopy (SEM) was used to document the presence or absence of delta in the CHT condition and in the MHT condition. As shown in FIGS. 2*a* and *b*, coarse δ precipitates (orthorhombic $Ni_3Nb$) were observed along the grain boundaries in the CHT condition, shown in FIG. 2*a*, and the absence of δ precipitates in the MHT condition is illustrated in FIG. 2*b*. Thus, Alloy 718 in the CHT condition has grain boundaries heavily decorated with δ phase, whereas Alloy 718 in the MHT condition has little or no δ phase at grain boundaries. The MHT condition of Alloy 718, which is annealed above the δ solvus, results in significant grain growth (from ASTM 8 to ASTM 3). Dark field transmission electron microscope (TEM) micrographs reveal the coarse γ' and γ'' morphology of the MHT condition of Alloy 718 as compared with the CHT condition of same, as shown in FIGS. 3*a* and *b*, respectively. Alloy 718 is strengthened by precipitation of γ' ($Ni_3$[Ti, Al]) and γ'' ($Ni_3Nb$).

Stress corrosion cracking tests were performed at 360° C. (680° F.) in flowing primary water in a pressurized water reactor environment to determine the relative susceptibility of the material conditions to intergranular stress corrosion cracking. Specifications for the test environment were:

| | |
|---|---|
| Dissolved oxygen | ≦0.01 ppm |
| Boric Acid | 5700 ppm ± 500 ppm |
| Lithium | 2 ppm |
| (LiOH) | (6.9 ppm) |
| pH | 6.5 (± 0.5) |
| Conductivity | <20 μS/cm |
| Dissolved Hydrogen | 15-50 Std. cc/Kg $H_2O$ |
| Chloride | <0.1 ppm |
| Flouride | <0.1 ppm |

The stress corrosion cracking test technique that was employed is a modified version of the Conventional Slow Strain-Rate Test. The modified stress corrosion cracking test technique yields significantly more data with respect to crack initiation and crack propagation as compared to the Conventional Stress Corrosion Cracking Test. The modified version of this test was conducted on a screw-driven creep/relaxation machine interfaced to an 18-bit waveform generator. The specimen geometry was a ½ T compact specimen, as per ASTM E399. Crack extension in the specimen was measured throughout the entire test with an alternating DC potential drop technique, known in the art. The resolution of this technique is approximately ±0.0005 in. and the extension rate was $5.0\times10^{-8}$ in./s.

Figure 4:
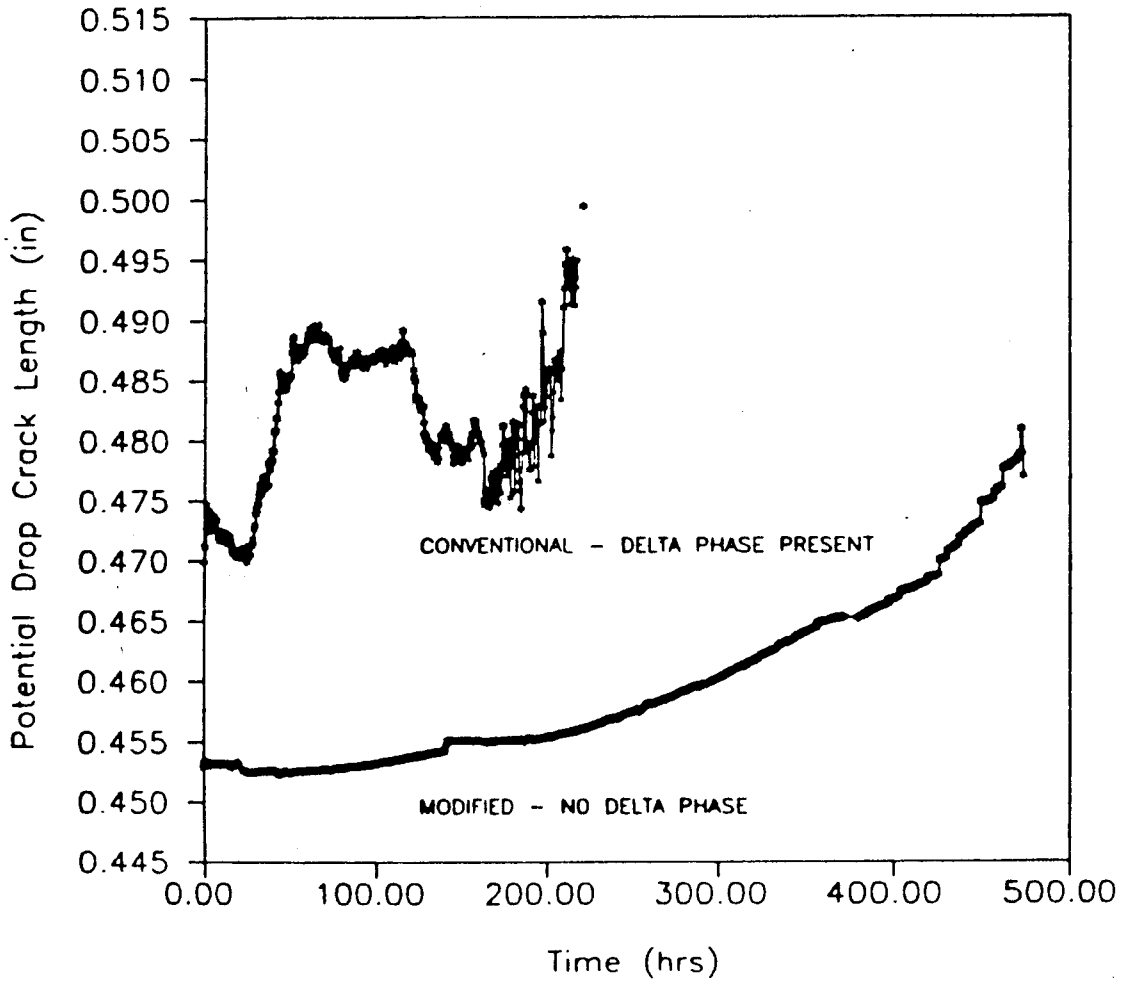
FIG. 4 is a graph of potential drop crack length versus time for Alloy 718 utilizing conventional heat treating (CHT) methods and the modified heat treating (MHT) method of the present invention.
Figure 5:
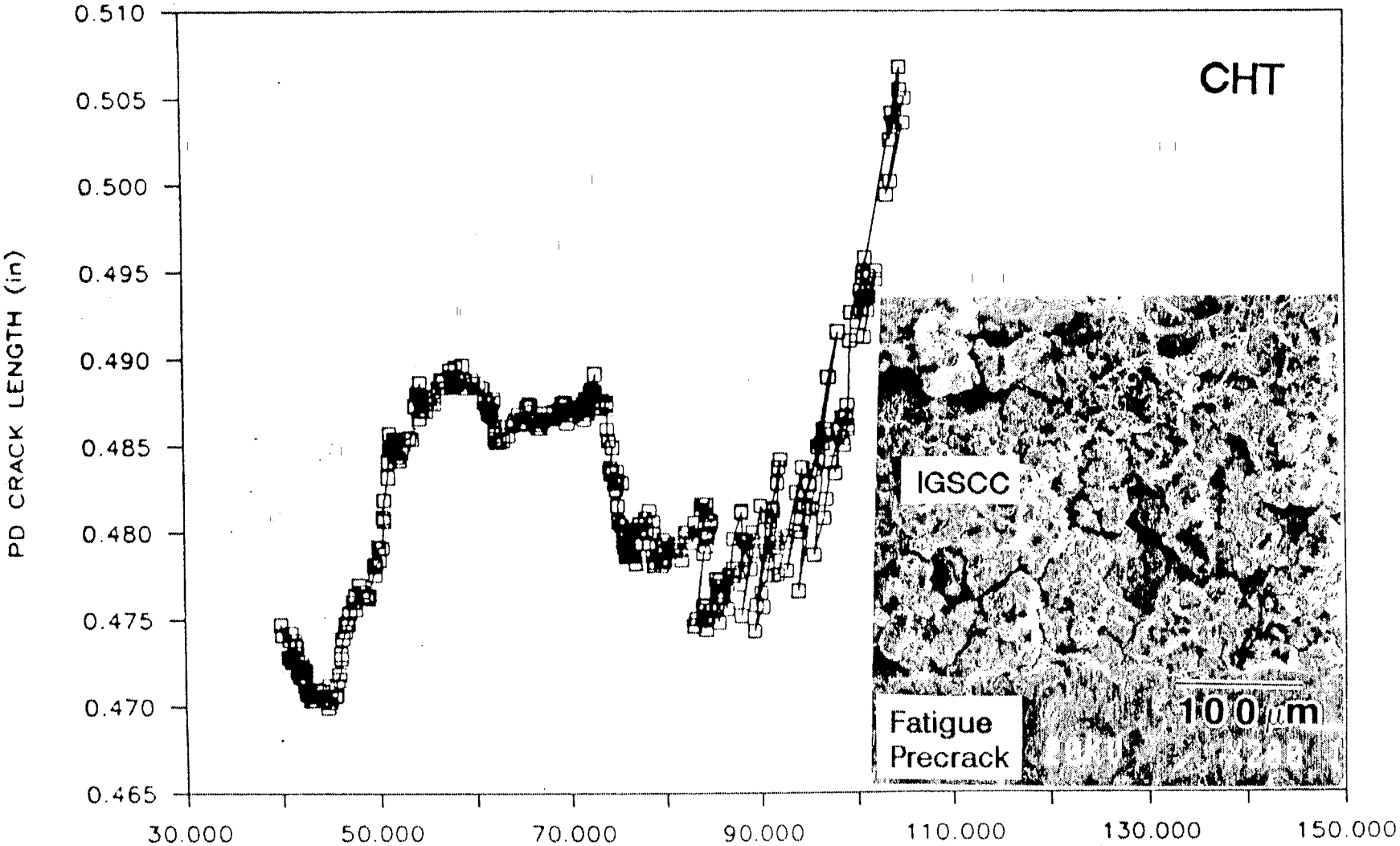
FIG. 5 is a graph of potential drop crack length versus stress intensity factor, K, for Alloy 718 utilizing conventional heat treating (CHT) methods and a scanning electron microscope (SEM) micrograph of the fracture surface.
Figure 6:
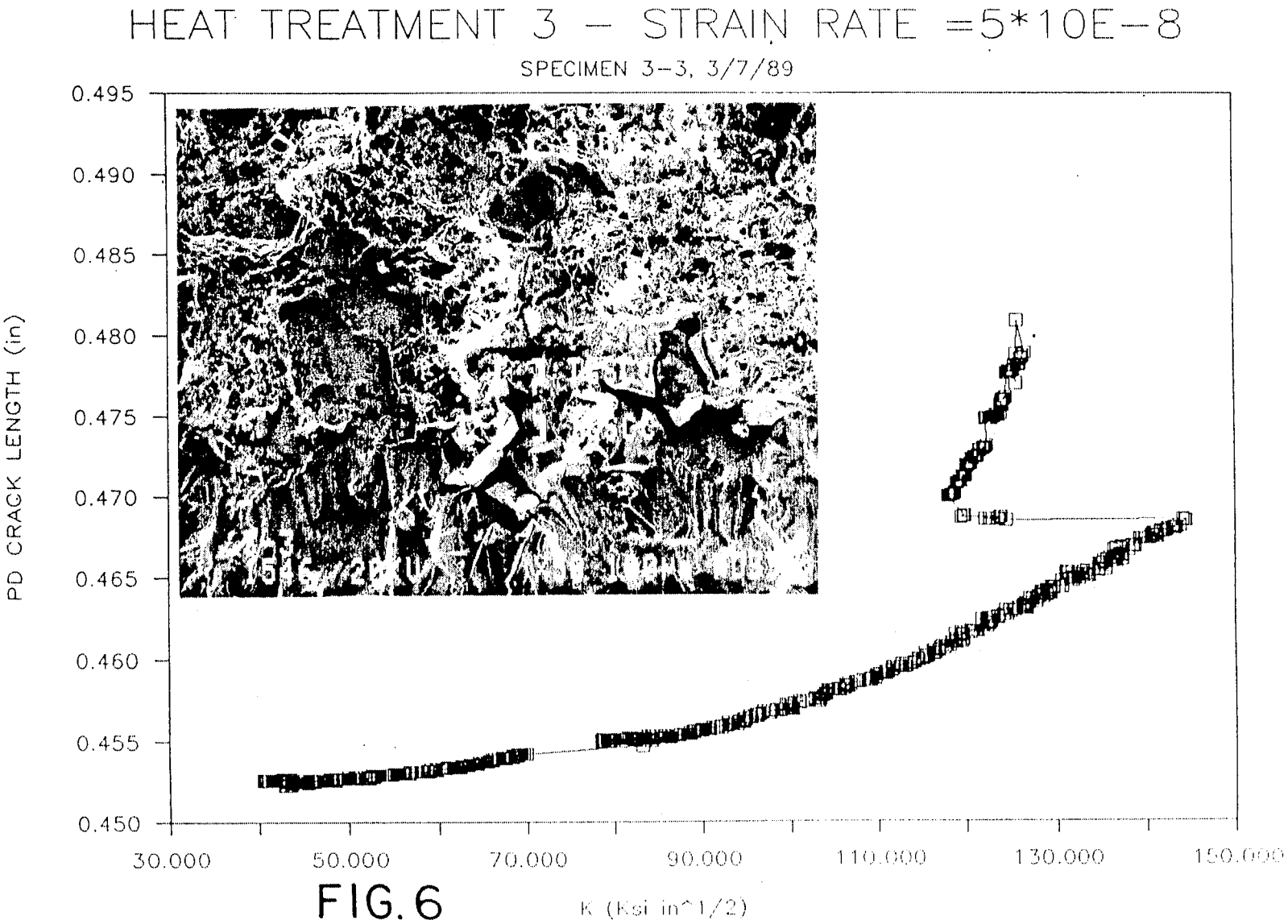
FIG. 6 is a graph of potential drop crack length versus stress intensity factor, K, for Alloy 718 utilizing the modified heat treating (MHT) method of the present invention and a scanning electron microscope (SEM) micrograph of the fracture surface.

With respect to the results of the foregoing test, the following data in Table III was taken from the graphs in FIGS. 4 and 5.

TABLE III

| Measurements | Conventional Heat Treatment | Modified Heat Treatment |
|---|---|---|
| Extension Rate (in/sec) | $5\times10^{-8}$ | $5\times10^{-8}$ |
| K initial* | 40 | 40 |
| K crack initiation* | 40 | 40 |
| K final* | 100 | 130 |
| t failure (Hrs.) | 220 | 470 |
| Failure mode | IGSCC | TGSCC |
| Grain Boundary Condition | Delta phase present | No delta phase present |

*Ksi/in

As can be seen from the foregoing table, the test results for the conventional heat treatment (CHT) condition, which has a δ phase decorating its grain boundaries, coupled with fractographic analysis, suggest that, at a stress intensity of approximately 40 Ksi/in., the crack began propagating intergranularly. The average crack growth rate in the CHT condition calculated using the initial and final crack lengths, was $1.4\times10^{-4}$ in/h. Similar test results for the Alloy 718 in the modified heat treatment (MHT) condition, which does not have δ phase present at the grain boundaries, did not show any crack growth until a stress intensity of approximately 40 Ksi/in., and the crack propagation mode was primarily transgranular. The average crack growth rate for the MHT condition was $6\times10^{-5}$ in/hr. This was significantly lower than the average crack growth rate for the CHT condition. The highest intergranular stress corrosion cracking resistance was associated with a microstructure free of δ phase. The increased stress corrosion cracking resistance exhibited by the MHT condition may be due to grain boundary homogeneity. Delta phase is high in niobium and chemically different from the matrix or gamma phase. Delta precipitates may act as local cathodes, causing the neighboring anodic matrix material to be attacked by the environment. The elimination of δ at the grain boundaries eliminates this galvanic cell and minimizes the environmental attack.

Tension tests were also conducted on the Alloy 718 material utilizing the conventional heat treatment (CHT) method and the modified heat treatment (MHT) method of the present invention. In this case, round bar tension tests (2 in. gage length, 0.25 in. gage diameter) were performed in air at room temperature and at 360 degrees C. (680 degrees F.), as per ASTM E-8. The results of these tests are shown in the following Table IV along with the current specification for Alloy X-750 in the HTH (CIB) condition, as commonly used in bolt heat treating.

TABLE IV

| Condition | 0.2% Yield Ksi | Ultimate Ksi |
|---|---|---|
| Alloy 718 CHT | 173 | 207 |
| Alloy 718 MHT | 130 | 185 |
| X-750 HTH (CIB) | 100 | 160 |

As can be seen from the foregoing table, Alloy 718 in the modified heat treatment (MHT) condition possesses a 30% increase in yield strength as compared to Alloy X-750 in the HTH condition. The MHT condition of Alloy 718 has approximately 75% of both the room temperature and 360 degrees C. (680 degrees F.) yield strength of the conventional heat treatment (CHT) condition of this Alloy. The coarse grain size coupled with the increased average γ' and γ'' particle diameter in the MHT condition are primarily responsible for this loss in strength. Other tests with respect to fatigue crack propagation behavior of the CHT and the MHT conditions have determined that the MHT condition result in lower fatigue crack propagation rates under continuous cycling.

In summary, the conventional heat treatment of Alloy 718 resulted in grain boundaries heavily decorated with δ phase. The modified heat treatment of the present invention of Alloy 718 resulted in grain boundaries free of δ phase precipitates. In general, it was found that:

1) Intergranular stress corrosion cracking resistance was highest for the microstructure which did not have δ phase present at the grain boundaries, i.e., the modified heat treatment (MHT) condition.

2) The crack propagation rate was lowest for the microstructure which did not have δ phase present at the grain boundaries, i.e., the modified heat treatment (MHT) condition.

3) The higher solution annealing temperature employed for the modified heat treatment (MHT) condition dissolved the lenticular δ precipitates. The absence of the δ particles at the grain boundaries increased the elemental homogeneity at the grain boundaries and enhanced the stress corrosion cracking resistance.

4) Alloy 718 in the modified heat treatment (MHT) condition had a 30% increase yield strength as compared to Alloy X-750 in the HTH condition.

Certain modifications and improvements will occur to those skilled in the art upon reading the foregoing. It should be understood that all such modification and improvements have been deleted herein for the sake of conciseness and readability, but are properly within the scope of the following claims.

We claim:

1. A method for increasing intergranular stress corrosion cracking resistance of Alloy 718 in water reactor environments comprising the steps of:

annealing the alloy at about 1093° C. (2000° F.) for about one hour;

cooling the alloy at about 56° C. (132.8° F.) per hour to about 718° C. (1325° F.);

aging the alloy at about 718° C. (1325° F.) for about four hours;

cooling the alloy at about 56° C. (132.8° F.) per hour to about 621° C. (1150° F.);

aging the alloy at 621° C. (1150° F.) for about sixteen hours;

cooling the alloy to room temperature; and employing structural members fabricated from the alloy in a water reactor environment.

2. The method as defined in claim 1, wherein the water reactor environment is a light water reactor environment.

3. The method as defined in claim 1, wherein the water reactor environment is a pressurized water reactor environment.

4. A product made in accordance with the method of claim 1.

* * * * *